US006047873A

United States Patent [19]

Carlberg et al.

[11] Patent Number: 6,047,873

[45] Date of Patent: Apr. 11, 2000

[54] WEB FEED GUIDE APPARATUS

[75] Inventors: David L. Carlberg; Theodore V. Meigs, both of Twain Harte, Calif.

[73] Assignee: Kinematic Automation, Inc., Twain Harte, Calif.

[21] Appl. No.: 09/273,961

[22] Filed: Mar. 22, 1999

[51] Int. Cl.[7] ..... B65H 20/00; B65H 57/04; G03B 1/52

[52] U.S. Cl. ..... 226/97.1; 242/615.3; 242/615.11

[58] Field of Search ..... 226/97.1, 97.3, 226/15; 242/615.11, 615.3

[56] References Cited

U.S. PATENT DOCUMENTS

| | | | |
|---|---|---|---|
| 3,318,640 | 5/1967 | Coville | 226/97.3 X |
| 3,544,732 | 12/1970 | Bauer et al. | 226/97.3 X |
| 4,131,320 | 12/1978 | Volat et al. | 226/97.3 X |
| 4,165,132 | 8/1979 | Hassan et al. | 242/615.11 X |
| 4,354,686 | 10/1982 | Imanishi et al. | 242/615.11 X |
| 4,384,666 | 5/1983 | Koponen et al. | 242/615.11 |
| 4,684,443 | 8/1987 | Kerttula et al. | 226/97.1 X |
| 4,793,749 | 12/1988 | Julius | 242/615.11 X |
| 4,964,584 | 10/1990 | Taipale et al. | 226/97.3 X |
| 5,102,118 | 4/1992 | Vits | 242/615.11 X |
| 5,432,653 | 7/1995 | Moore et al. | 226/97.3 X |

FOREIGN PATENT DOCUMENTS

| | | | |
|---|---|---|---|
| 2647963 | 4/1978 | Germany | 226/97.3 |

*Primary Examiner*—Donald P. Walsh
*Assistant Examiner*—Collin A. Webb
*Attorney, Agent, or Firm*—Harris Zimmerman

[57] ABSTRACT

In an apparatus for feeding and delivering a thin web in a longitudinal direction, a web guide for precisely controlling the lateral position of the web includes an assembly formed of a platen and mating cover. The platen is provided with an upper surface having a shallow channel formed therein, the channel being sufficiently deep to receive the thickness of the web. The channel includes opposed parallel edges, either one of which may be designated a reference edge. The channel is dimensioned to be wider than the thin web or film. The platen includes a plurality of shallow grooves extending laterally across the upper surface of the platen and the bottom surface of the channel and spaced longitudinally therealong. The cover includes a generally planar bottom surface that mates with the platen to seal the top of the channel. Air is introduced into the shallow grooves at like ends thereof that are opposite the designated reference edge of the channel. The web is fed longitudinally through the channel, and the lateral air flow through the shallow grooves urges the web toward the reference edge. The low pressure air flow may be adjusted so that the edge of the web abuts the reference edge, so that precise positional control of the web is obtained. In a further aspect, the cover may include shallow grooves extending laterally and spaced in registration with the shallow grooves of the channel, so that air flow occurs both above and below the web feeding through the channel.

17 Claims, 5 Drawing Sheets

WEB FEED GUIDE APPARATUS

BACKGROUND OF THE INVENTION

This invention relates to web feed control devices and, more particularly, to devices that control the lateral position of a narrow continuous web that is fed longitudinally.

Many medical, chemical and biological diagnostic tests and assays for laboratory and home use have been reduced to an optimally simple routine: immerse a test strip or stick into a liquid, and observe the change in color of the test strip or stick to read the results of the test. Tests that formerly required days of laboratory work may now be carried out in seconds, with a reliability factor that exceeds former, more time-consuming methods. Generally speaking, the strips or sticks (hereinafter, "strips") comprise long, narrow pieces of paper, plastic, or similar sheet material that carry carefully formulated combinations of highly specific reagents, reactants, or assay compounds.

The individual reactants that comprise a particular test or assay may be embodied in respective lamina which are applied to the base strip. These lamina are formed of thin web material in which the reactant is dispersed in a concentration that is precisely controlled. Often the thin web material is a thin film having little structural strength and a low ratio of weight to surface area. As a result of such factors, these thin films may present serious problems in handling, particularly by automated fabrication machinery.

A common fabrication technique for test strips is to fabricate cards of base material, and to laminate a combination of thin film strips extending laterally across each card. Because the thin film strips are carriers for the respective reactants, it is crucial that the thin film strips be placed precisely and reliably in the same locations on each card, so that the interactions of the reactants are facilitated in a manner that does not vary from card to card. Each card is then slitted longitudinally into a plurality of strips, each strip bearing the same combination of all the thin film strips.

Due to the delicate nature of some of these thin film lamina, it can be difficult to feed the lamina from a supply reel onto a base card at a precise position. Conventional feed rollers may tear the film or abrade the surface, and side guides may fray the edges. The prior art is deficient in apparatus designed to deliver a delicate thin film longitudinally while precisely locating the edges of the thin film in a lateral direction.

SUMMARY OF THE INVENTION

The present invention generally comprises an apparatus for feeding and delivering thin film material in a longitudinal direction while precisely controlling the lateral position of the thin film.

In one aspect, the invention includes the use of air flowing laterally past a thin web that is being fed longitudinally, so that the thin web is urged against a reference edge that provides lateral positional control of the thin web. In this manner the lateral position of the web may be controlled within very close tolerances (±0.003 inches) for applications that require such precision.

In another aspect, the invention includes a web feed control apparatus for precisely locating the lateral position of a thin web or film that is being fed longitudinally to a work site, such as a film or web applier, reel winder, or the like. The web feed control apparatus includes an assembly formed of a platen and mating cover. The platen is provided with an upper surface having a shallow channel formed therein, the channel being sufficiently deep to receive the thickness of the thin web or film. The channel includes opposed parallel edges, either one of which may be designated a reference edge. The channel is dimensioned to be wider than the thin web or film.

The platen includes a plurality of shallow grooves extending laterally across the bottom surface of the channel and spaced longitudinally therealong. The cover includes a generally planar bottom surface that mates with the platen to seal the top of the channel. Air is introduced into the shallow grooves at like ends thereof that are opposite the designated reference edge of the channel. The web is fed longitudinally through the channel, and the lateral air flow through the shallow grooves urges the web toward the reference edge. The low pressure air flow may be adjusted so that the edge of the web abuts the reference edge, so that precise positional control of the web is obtained without resort to mechanical or frictional devices such as guide rollers, guide fingers, or the like.

In a further aspect, the cover may be provided with shallow grooves extending laterally and spaced in registration with the shallow grooves of the channel, so that air flow occurs both above and below the web feeding through the channel.

In one embodiment the platen is provided with air manifolds formed at either side and disposed to be in flow communication with the opposed ends of the shallow grooves. Either manifold may comprise the input manifold, and the other the exhaust manifold, whereby air may be directed in either lateral direction and either edge of the channel may be designated as the reference edge.

In another embodiment, the platen includes a plurality of holes formed in the sides thereof, each hole leading to one end of a shallow groove. The holes at one side are provided with low pressure air to cause lateral air flow that drives the web laterally toward the opposite side of the channel. The holes may extend generally coaxially with the shallow grooves, or may intersect the grooves at a predetermined angle, such as $\leqq 45°$.

DESCRIPTION OF THE PREFERRED EMBODIMENT

Figure 1:
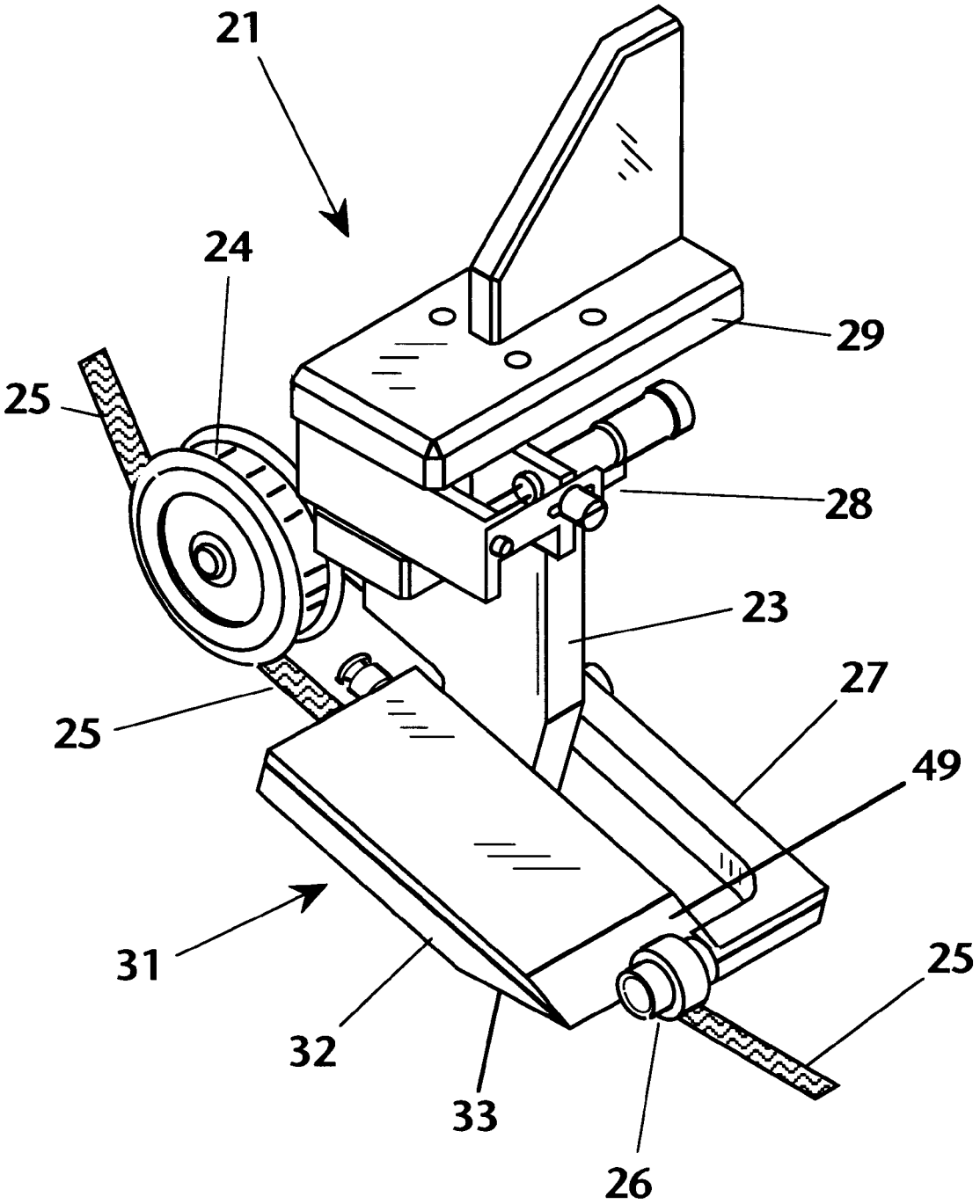
FIG. 1 is a perspective view of a web or film applicator device employed in conjunction with the web feed control apparatus of the invention.
Figure 2:
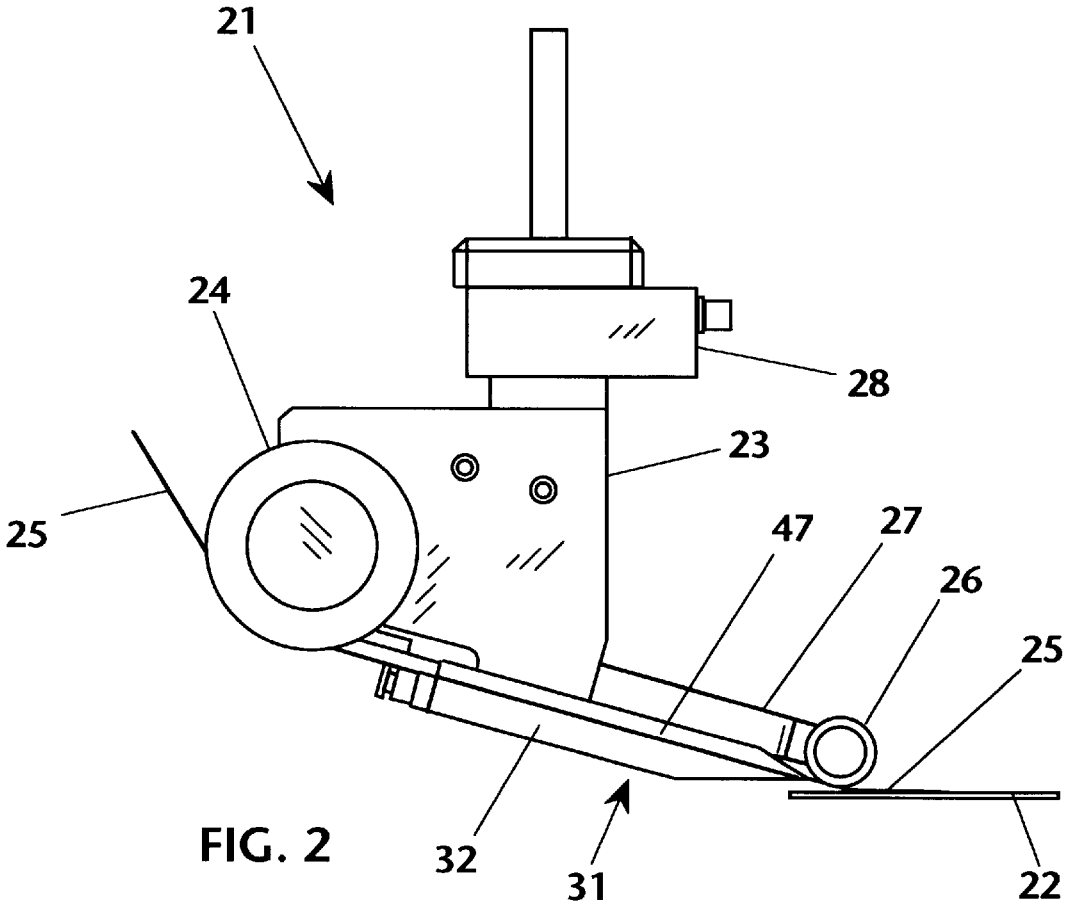
FIG. 2 is a side elevation of the web or film applicator device depicted in FIG. 1, showing the use of the web feed control apparatus of the invention.

The present invention generally comprises an apparatus for feeding and delivering thin film material in a longitudinal direction while precisely controlling the lateral position of the thin film. With regard to FIGS. 1 and 2, the preferred embodiment is used in conjunction with an apparatus 21 adapted for applying thin narrow webs or film to the surface of an object, such as a carrier base web 22. The apparatus 21, which comprises no part of the invention and is shown for example only, includes a central structure 23 which supports a tension roller 24 that receives a thin web or film 25 (hereinafter, web 25) from a supply reel or the like. A pressure roller 26 is supported on an arm 27, which in turn is secured to the central structure 23 in pivotally adjustable fashion. The central structure 23 is secured to a micrometer slide 28, which in turn is supported by a fixed strut 29. The web 25 is fed past the tension roller 24 to the pressure roller 26, which applies the web 25 to the base carrier 22.

It is frequently necessary to control the lateral position of the web 25 as it is applied to the base carrier 22. Lateral positional control of the web 25 is provided by the web guide assembly 31, which is secured to the central structure 23 and disposed intermediate of the tension roller 24 and the pressure roller 26. It may be appreciated that the lateral position of the conjoint assembly of the rollers 24 and 26 and the web guide assembly 31 is set by the micrometer slide 29 and that the web 25 can be guided with great accuracy by the assembly 31, whereby the web 25 may be delivered with high lateral precision by the apparatus.

Figure 3:
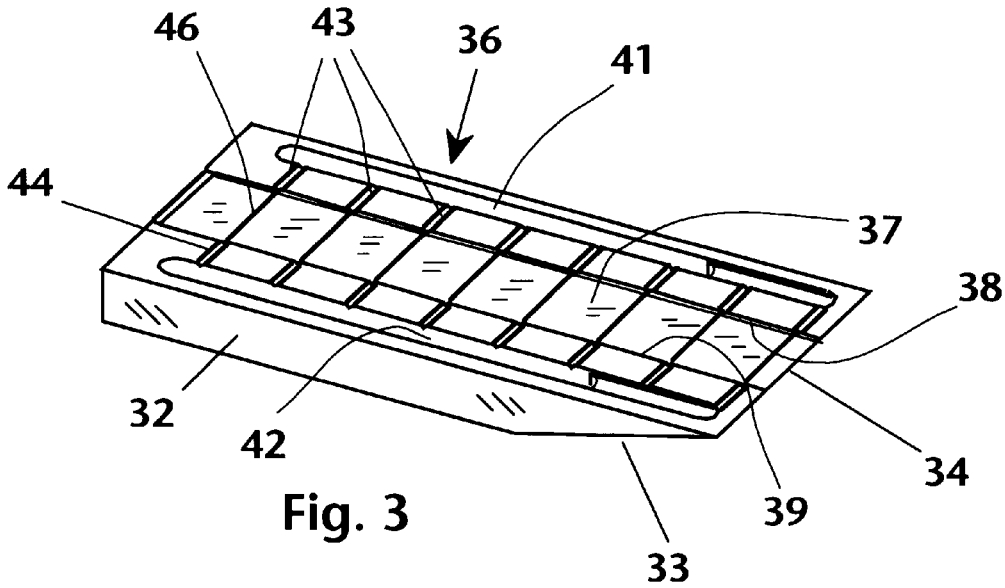
FIG. 3 is a perspective view of the platen of the web feed control apparatus.
Figure 4:
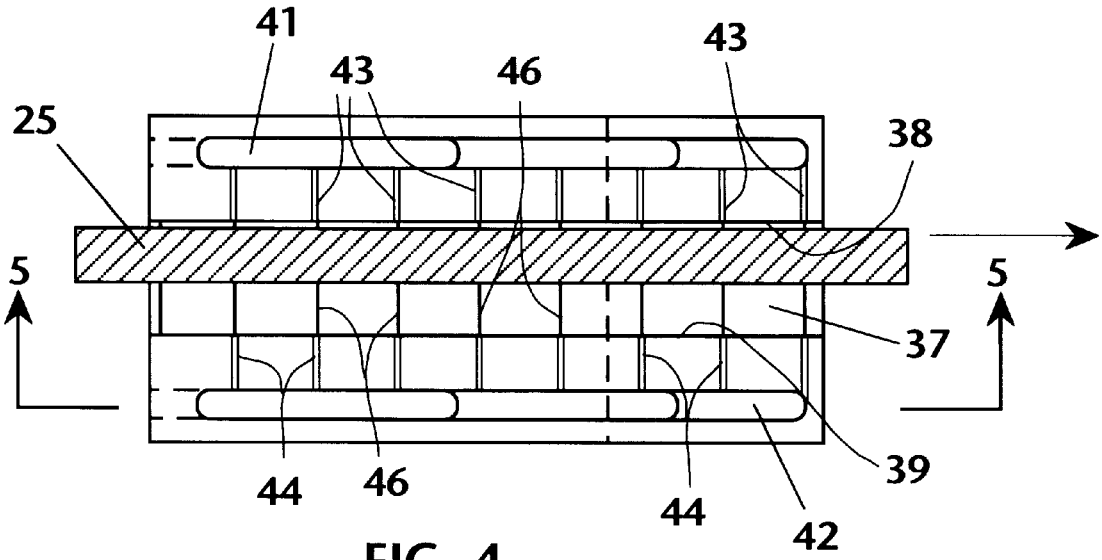
FIG. 4 is a plan view of the platen depicted in FIG. 3.
Figure 5:
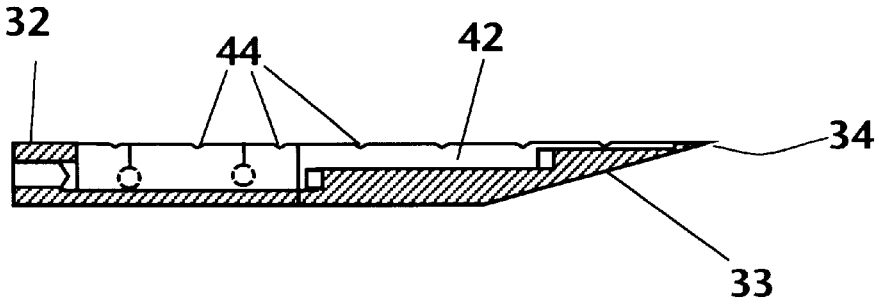
FIG. 5 is a cross-sectional side elevation of the platen, taken along line 5—5 of FIG. 4.

With regard to FIGS. 3–5, one component of the web guide assembly 31 is a platen 32 having a generally rectangular conformation and a tapered bottom surface 33 adjacent to outlet end 34. The platen includes a planar upper surface 36, and a shallow channel 37 extends the length thereof and oriented coaxially with the longitudinal axis of the rectangular conformation. The channel is a shallow rectangular recess having opposed parallel edges 38 and 39, the width of the channel being wider than the web 25. A pair of air manifolds 41 and 42 are formed in the platen, the manifolds extending longitudinally with stepped depth (FIG. 5) and disposed in parallel, spaced apart relationship on opposite sides of the channel 37.

A plurality of shallow V grooves 43 are formed in the upper surface 36 of the platen, the grooves 43 being spaced apart along the longitudinal axis and arrayed in parallel fashion, the grooves 43 extending between the manifold 41 and the edge 38 of the channel 37. Likewise, a similar plurality of shallow V grooves 44 extend in parallel array between the manifold 42 and the edge 39 of the channel 37. A plurality of shallow grooves 46 extend in a like parallel, spaced array in the bottom surface of the channel 37, each groove 46 extending between respective grooves 43 and 44 to form therewith a lateral airflow path.

Figure 7:
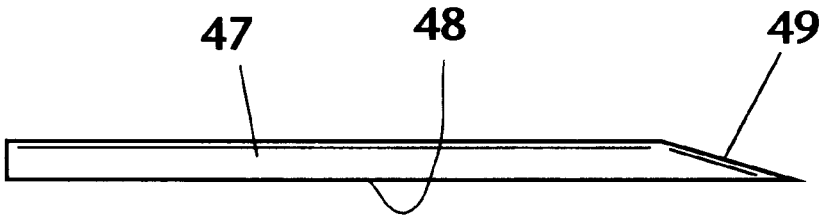
FIG. 7 is a side elevation of the cover depicted in FIG. 6.
Figure 6:
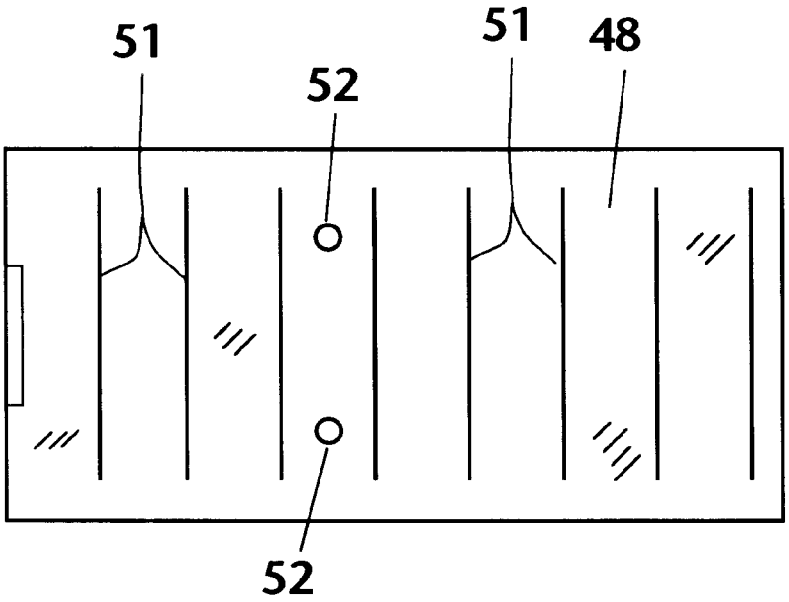
FIG. 6 is a plan view of the cover of the web feed control apparatus.
Figure 8:
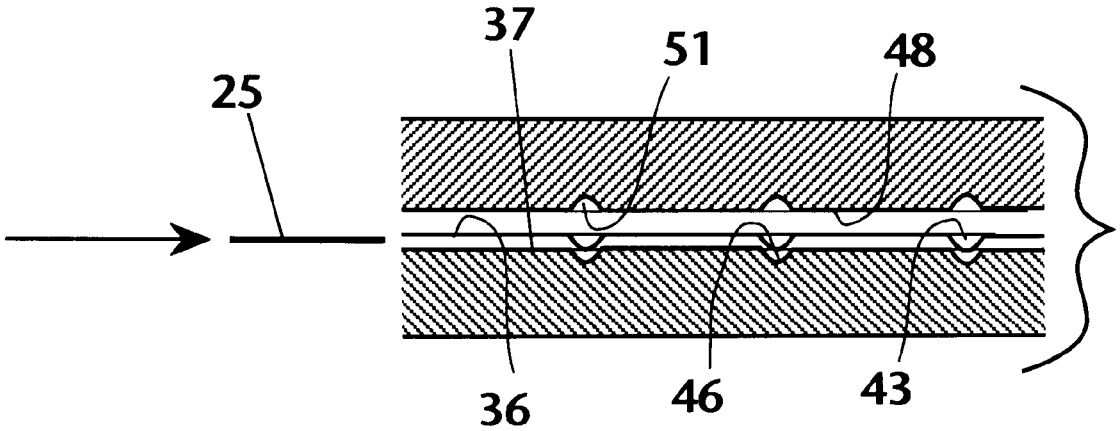
FIG. 8 is an enlarged cross-sectional side elevation showing a web translating into the assembly of the platen and cover.
Figure 9:
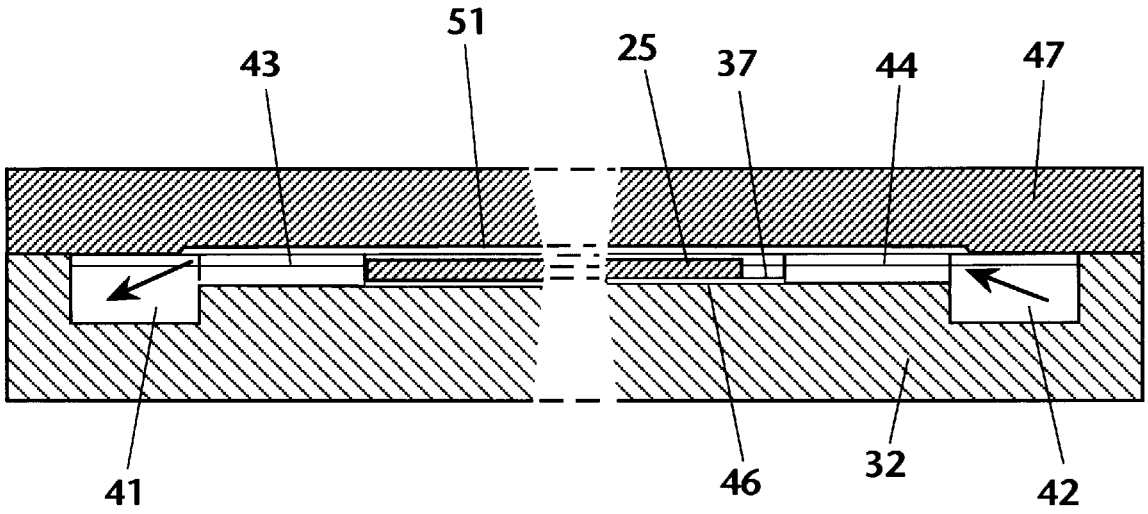
FIG. 9 is a cross-sectional end elevation showing the air flow path through the web feed control apparatus.

With regard to FIGS. 6 and 7, the web guide assembly 31 further includes a cover plate 47 having a rectangular plan configuration similar to the platen 32, and a bottom surface 48 dimensioned to mate with the top surface 36 of the platen. One end is provided with a taper 49 similar to the taper 33 of the platen 32. A plurality of grooves 51 are formed in the surface 48 and arrayed in a like parallel, spaced array, so that each groove 51 is disposed in registration and flow communication with the airflow paths formed by the aligned grooves 43, 44, and 46. The cover 47 is secured to the platen 32 by screws received in threaded holes 52. The surface 48 forms a seal with the surface 36, sealing the manifolds 41 and 42. The surface 48 also forms with the channel 37 a shallow rectangular conduit that is open only at the opposed ends of the assembly 31. The conduit is somewhat wider than the web 25, and slightly greater in height than the thickness of the web 25, as shown in FIG. 9. In addition, the grooves 43, 44, 46, and 51 define airflow paths laterally from one manifold to the other, and there is little other open flow space for airflow, due to the limited clearance between the height of the conduit and the thickness of the web 25.

The viscosity of the air generates drag on the web 25, and the drag of the lateral airflow through the aligned grooves creates a lateral force on the web 25 that urges the web in the direction of airflow. Either side 38 or 39 may be designated as a reference edge, and air under minimal pressure may be introduced into the appropriate manifold 41 or 42 to urge the web toward the opposite edge of the channel 37. The confinement of the conduit prevents the web from lateral overtravel, as there is no space available for an edge of the web 25 to fold or buckle against the side 38 or 39. Thus precise lateral positioning of the web 25 with respect to the platen is obtained, without resort to guide rollers, guide fingers, or the like. The reference edge 38 or 39 may be precisely aligned with an object 22 receiving the web 25 by use of the micrometer slide, so that the web 25 may be placed within a tolerance of ±0.003 inch. Moreover, the airflow through the channel conduit lubricates translation and minimizes drag, thus imparting little additional strain to the web 25 during the web feeding process.

Figure 10:
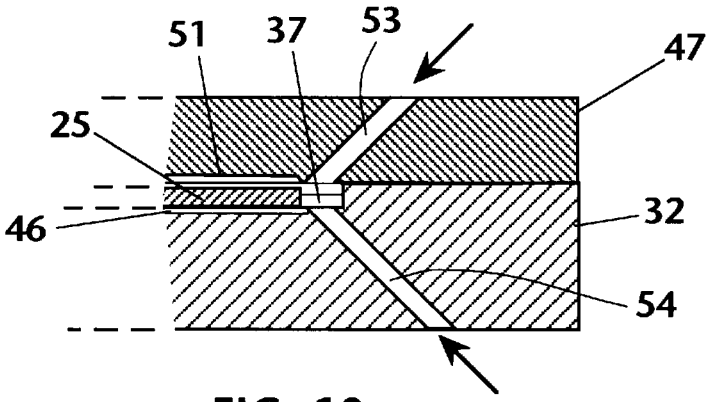
FIG. 10 is a cross-sectional partial end elevation depicting an alternative embodiment of the air flow path through the web feed control apparatus.

In a further embodiment of the invention, shown in FIG. 10, components and elements similar to the previous embodiment are labeled with the same reference numerals. The air manifold is eliminated; rather, a plurality of paired air inlet passages 53 and 54 extend obliquely through the cover 47 and platen 32, respectively, to join the channel 37 at conjunctions with the grooves 46 and 51. The inlets 53 and 54 are disposed at angles ≦45°, and may be joined to an air supply through individual air tubes or through an external manifold. The opposite side of the assembly 31 may be formed with like passages 53 and 54, or may provide an internal manifold such as the manifolds 41 and 42 described previously.

Figure 11:
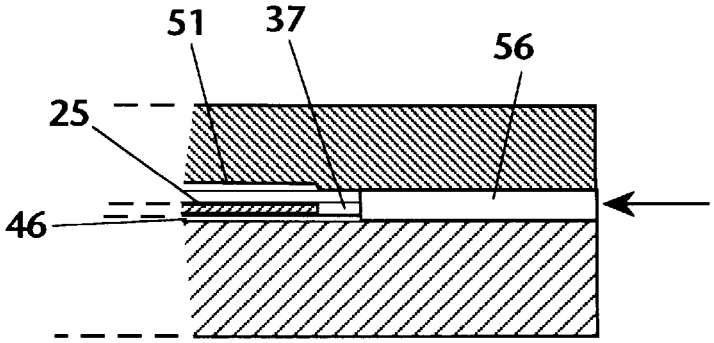
FIG. 11 is a cross-sectional partial end elevation depicting a further alternative embodiment of the air flow path through the web feed control apparatus.

In a further embodiment of the invention, shown in FIG. 11, components and elements similar to the previous embodiment are labeled with the same reference numerals. This embodiment provides a plurality of air inlet passages 56, each extending from the exterior side of the assembly directly to the channel 37 at a conjunction with the grooves 46 and 51. The passages 56 may be joined to an air supply through individual air tubes or through an external manifold. The opposite side of the assembly 31 may be formed with like passages 56, or may provide passages 53 and 54, or an internal manifold such as the manifolds 41 and 42, as described previously.

In all embodiments, controlled lateral airflow is employed to urge the thin web 25 to translate longitudinally through the web guide assembly 31 in impingement with a defined reference edge 38 or 39, so that the micrometer slide 28 may be employed to positively locate, within very close tolerances, the position at which the web 25 is applied to an object.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

We claim:

1. A web guide assembly for precise lateral positional control of a web translating in a longitudinal direction, including:

a conduit having a side wall and a width, said width greater than the lateral width of the web and a height slightly greater than the thickness of the web and a length along which the web translates;

means for directing an airflow laterally across said conduit toward said side wall, said airflow exerting a lateral force on the web and urging the web to impinge on said side wall.

2. The web guide assembly of claim 1, wherein said means for directing an airflow includes a plurality of grooves extending laterally across said conduit.

3. The web guide assembly of claim 1, wherein said web guide assembly includes a platen having an upper surface, and a shallow channel formed in said upper surface and defining a portion of said conduit, said channel extending in the direction of said length of said conduit.

4. The web guide assembly of claim 3, wherein said means for directing an airflow includes a first plurality of grooves extending laterally in a bottom surface of said channel, said grooves being spaced along the length of said channel.

5. The web guide assembly of claim 4, further including means for supplying low pressure air to first like ends of said first plurality of grooves, and means for exhausting said air from opposite, second like ends of said first plurality of grooves.

6. The web guide assembly of claim 5, wherein said means for supplying air includes a first manifold disposed in flow communication with said first like ends of said first plurality of grooves.

7. The web guide assembly of claim 6, wherein said first manifold includes a first slot extending along the length of said upper surface and connecting to said first like ends.

8. The web guide assembly of claim 7, further including a second manifold disposed in flow communication with said second like ends of said first plurality of grooves.

9. The web guide assembly of claim 8, wherein said second manifold includes a second slot extending along the length of said upper surface and connecting to said second like ends.

10. The web guide assembly of claim 9, further including a cover secured to said upper surface of said platen in sealing relationship, said cover forming a top surface of said conduit and sealing said first and second manifolds.

11. The web guide assembly of claim 10, further including a second plurality of grooves extending laterally in said cover and disposed in registration with said first plurality of grooves.

12. The web guide assembly of claim 11, wherein said second plurality of grooves extend from said first manifold to said second manifold to conduct airflow therebetween in a lateral direction.

13. The web guide assembly of claim 5, wherein said means for supplying air includes a first plurality of air passages extending through said platen to said like first ends of said first plurality of grooves.

14. The web guide assembly of claim 13, wherein said first plurality of air passages extend at an angle in the range of 0°–45° to said upper surface of said platen.

15. The web guide assembly of claim 14, further including a cover adapted to be secured to said upper surface of said platen in mating relationship, said cover forming a top wall portion of said conduit.

16. The web guide assembly of claim 15, wherein said means for supplying air includes a second plurality of air passages extending through said cover to said like first ends of said first plurality of grooves.

17. The web guide assembly of claim 16, wherein said second plurality of air passages extend at an angle in the range of 0°–45° to said cover.

* * * * *